US011105141B2

(12) United States Patent
Kito et al.

(10) Patent No.: US 11,105,141 B2
(45) Date of Patent: Aug. 31, 2021

(54) CONTROL DEVICE AND PROGRAM

(71) Applicant: AISIN SEIKI KABUSHIKI KAISHA, Kariya (JP)

(72) Inventors: Kosuke Kito, Chiryu (JP); Takuro Oshida, Anjo (JP); Osamu Uno, Kasuya-gun (JP); Satoshi Mori, Kasuya-gun (JP); Shingo Fujimoto, Tokai (JP)

(73) Assignee: AISIN SEIKI KABUSHIKI KAISHA, Toyota (JP)

( * ) Notice: Subject to any disclaimer, the term of this patent is extended or adjusted under 35 U.S.C. 154(b) by 360 days.

(21) Appl. No.: 16/188,501

(22) Filed: Nov. 13, 2018

(65) Prior Publication Data

US 2019/0169917 A1 Jun. 6, 2019

(30) Foreign Application Priority Data

Dec. 1, 2017 (JP) ..... JP2017-232046

(51) Int. Cl.
*E05F 15/73* (2015.01)

(52) U.S. Cl.
CPC ..... *E05F 15/73* (2015.01); *E05F 2015/767* (2015.01); *E05Y 2400/86* (2013.01); *E05Y 2900/542* (2013.01); *E05Y 2900/55* (2013.01)

(58) Field of Classification Search
CPC ..... E05F 15/73; E05F 2015/767; E05Y 2400/86; E05Y 2900/55; E05Y 2900/542
USPC ..... 701/49
See application file for complete search history.

(56) References Cited

U.S. PATENT DOCUMENTS

| | | | | |
|---|---|---|---|---|
| 9,448,641 | B2 | 9/2016 | Hamada et al. | |
| 2012/0312676 | A1 | 12/2012 | Salter et al. | |
| 2015/0336521 | A1* | 11/2015 | Tofilescu | G06K 9/00791 382/104 |
| 2019/0136964 | A1* | 5/2019 | Tapia | B60K 35/00 |

FOREIGN PATENT DOCUMENTS

| | | | |
|---|---|---|---|
| JP | 2007-186915 A | | 7/2007 |
| JP | 2007186915 | * | 7/2007 |
| JP | 2015-219885 A | | 12/2015 |
| JP | 2017-033144 A | | 2/2017 |
| WO | WO-2016155960 | * | 10/2016 |

* cited by examiner

*Primary Examiner* — Muhammad Shafi
(74) *Attorney, Agent, or Firm* — Sughrue Mion, PLLC

(57) ABSTRACT

A control device includes: a detection unit that detects a reference position indicating a position serving as a reference among passenger's predetermined portions based on a captured image captured by an imaging device that images an interior of a vehicle; and a control unit that is provided in the vehicle and performs control such that, during a closing operation of an openable and closable opening and closing member, the closing operation of the opening and closing member is interrupted, when a coordinate value of the reference position detected by the detection unit exceeds a threshold value.

7 Claims, 7 Drawing Sheets

| COMMAND | ACTION |
| --- | --- |
| OPEN | MOVE HAND IN OPENING DIRECTION |
| CLOSE | MOVE HAND IN CLOSING DIRECTION |
| PAUSE | RAISE FIST |

CONTROL DEVICE AND PROGRAM

CROSS REFERENCE TO RELATED APPLICATIONS

This application is based on and claims priority under 35 U.S.C. § 119 to Japanese Patent Application 2017-232046, filed on Dec. 1, 2017, the entire contents of which are incorporated herein by reference.

TECHNICAL FIELD

This disclosure relates to a control device and a program.

BACKGROUND DISCUSSION

In the related art, a technique for detecting pinch of foreign matter by an opening and closing member of a vehicle such as a power window and the like is known. For example, JP 2007-186915A (Reference 1) discloses a technique for detecting whether pinch of a foreign matter occurs by a window based on a feature value obtained from brightness reflected in image data captured by imaging means.

In the related art technique described above, an outline of an object (such as a window) is extracted based on the brightness of the image data, and occurrence of pinch of a foreign matter is detected by using a change quantity and an area of the extracted outline as a feature value, but when there is a large error in the extracted outline, since the occurrence of the pinch of the foreign matter in the opening and closing member of the vehicle can not be detected with high accuracy, there is a problem that it is difficult to completely prevent the pinch.

SUMMARY

A control device according to an aspect of this disclosure includes a detection unit that detects a reference position indicating a position serving as a reference among passenger's predetermined portions based on a captured image captured by an imaging device that images an interior of a vehicle, and a control unit that is provided in the vehicle and performs control such that, during a closing operation of an openable and closable opening and closing member, the closing operation of the opening and closing member is interrupted, when a coordinate value of a reference position detected by the detection unit exceeds a threshold value.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, a control device and a program disclosed here will be described in detail with reference to the accompanying drawings.

First Embodiment

Figure 1:
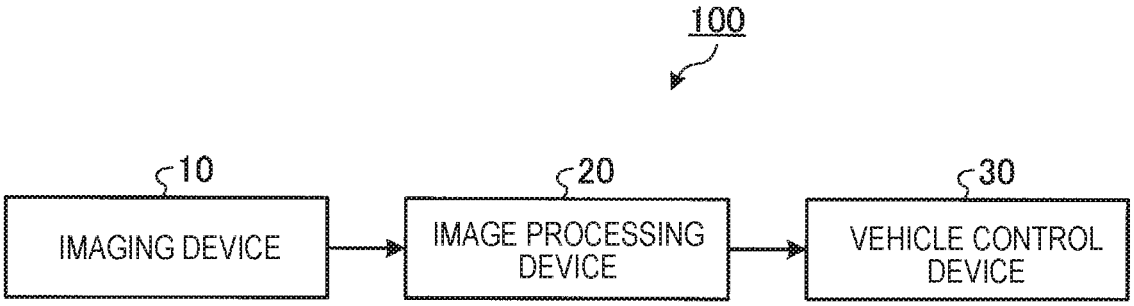
FIG. 1 is a diagram showing a schematic configuration of an information processing system according to an embodiment.

FIG. 1 is a diagram showing a schematic configuration of an information processing system 100 mounted on a vehicle such as an automobile including a driving source such as an engine or a motor. In the present embodiment, it is assumed that a configuration is provided, in which a command is executed automatically when a passenger of the vehicle performs on an action (gesture) corresponding to any command. For example, when the passenger performs an action corresponding to the command for instructing an opening operation/closing operation of an openable and closable sunroof (as an example of an "openable and closable opening and closing member provided in the vehicle"), the command is executed automatically. However, this disclosure is not limited to this, and for example, the opening and closing control of the sunroof may be performed without requiring gesture recognition. For example, an operation unit (such as a button, for example) for accepting an opening/closing instruction for the sunroof is provided, and the sunroof opening and closing operation may be automatically performed according to the instruction accepted by the operation unit.

As shown in FIG. 1, the information processing system 100 includes an imaging device 10, an image processing device 20, and a vehicle control device 30.

The imaging device 10 is a device that images an interior of the vehicle. For example, the imaging device 10 includes a camera. In this example, the imaging device 10 continuously images at a predetermined frame rate. An image captured by the imaging device 10 (may be hereinafter referred to as "captured image") is input to the image processing device 20.

Based on the captured image input from the imaging device 10, the image processing device 20 determines whether an action corresponding to any command is performed, and when the determination result is affirmative, outputs information (command information) indicating a command permitting output to the vehicle control device 30. In addition, the image processing device 20 detects whether pinch of a predetermined portion of the passenger occurs during a closing operation of a sunroof and controls such that the closing operation of the sunroof is interrupted, when detecting that the pinch of the predetermined portion of the passenger occurs. In this example, the image processing device 20 is an example of the "control device". A specific configuration of the image processing device 20 will be described below.

The vehicle control device 30 controls respective components of the vehicle according to the command indicated by command information input from the image processing device 20.

Figure 2:
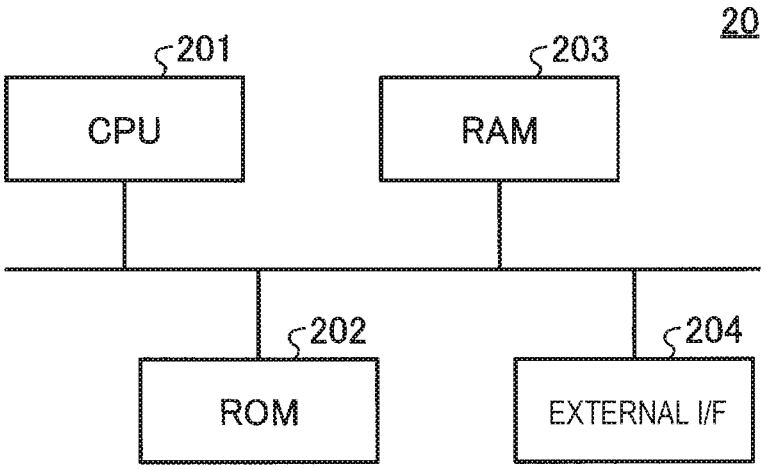
FIG. 2 is a diagram showing an example of a hardware configuration of an image processing device.

Hereinafter, a specific configuration of the image processing device 20 of the present embodiment will be described. FIG. 2 is a diagram showing an example of a hardware configuration of the image processing device 20. As shown in FIG. 2, the image processing device 20 includes a CPU 201, a ROM 202, a RAM 203, and an external I/F 204. In this example, the image processing device 20 has the same hardware configuration as a normal computer. It should be noted that the hardware elements included in the image processing device 20 are not limited to the hardware elements shown in FIG. 2, and other hardware elements may be further provided.

By executing the program, the CPU 201 comprehensively controls the operation of the image processing device 20 and realizes various functions included in the image processing device 20. Various functions included in the image processing device 20 will be described below.

The ROM 202 is a nonvolatile memory and stores various data including a program for starting up the image processing device 20. The RAM 203 is a volatile memory including a work area of the CPU 201.

The external I/F 204 is an interface for connecting to an external device. For example, as the external I/F 204, an interface for connecting to the imaging device 10 and an interface for connecting to the vehicle control device 30 are provided.

Figure 3:
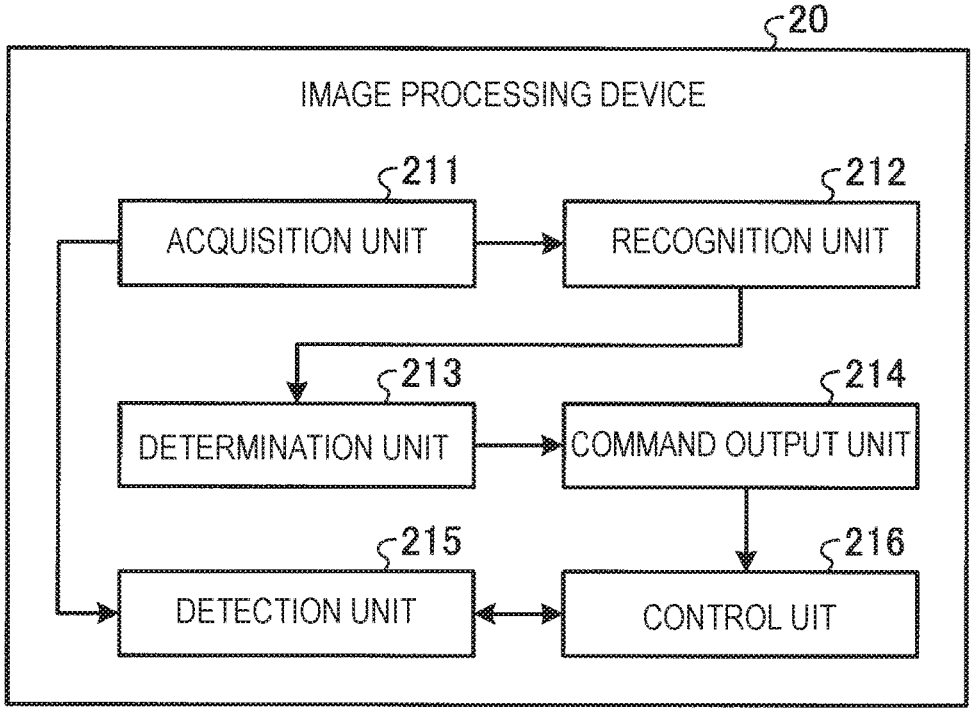
FIG. 3 is a view showing an example of a function included in an image processing device.

FIG. 3 is a diagram showing an example of functions included in the image processing device 20. In the example of FIG. 3, only the functions relating to this disclosure are illustrated, but the functions included in the image processing device 20 are not limited thereto.

As shown in FIG. 3, the image processing device 20 includes an acquisition unit 211, a recognition unit 212, a determination unit 213, a command output unit 214, a detection unit 215, and a control unit 216. In this example, the CPU 201 executes a program stored in a storage device such as the ROM 202, so that respective functions of the acquisition unit 211, the recognition unit 212, the determination unit 213, the command output unit 214, the detection unit 215, and the control unit 216 are realized. However, this disclosure is not limited thereto, and for example, at least a part of the acquisition unit 211, the recognition unit 212, the determination unit 213, the command output unit 214, the detection unit 215, and the control unit 216 may be configured as a dedicated hardware circuit.

The acquisition unit 211 acquires a captured image from the imaging device 10. Every time the imaging device 10 images, the acquisition unit 211 acquires a captured image obtained by the image capturing.

The recognition unit 212 recognizes an action of the passenger based on the captured image (captured image captured by the imaging device 10) acquired by the acquisition unit 211. In this example, the action of the passenger is an action mode using hands, but not limited thereto.

Various known techniques can be used as a method for recognizing the action of the passenger based on the captured image. For example, an embodiment may utilize the technique disclosed in Japanese Patent Application No. 2017-182748. In the present embodiment, the recognition unit 212 extracts joints (feature points) of each of portions of passenger's body (upper body) reflected in the captured image and generates skeleton information (skeleton data). Then, the recognition unit 212 recognizes the action of the passenger based on the generated skeleton information.

Figure 4:
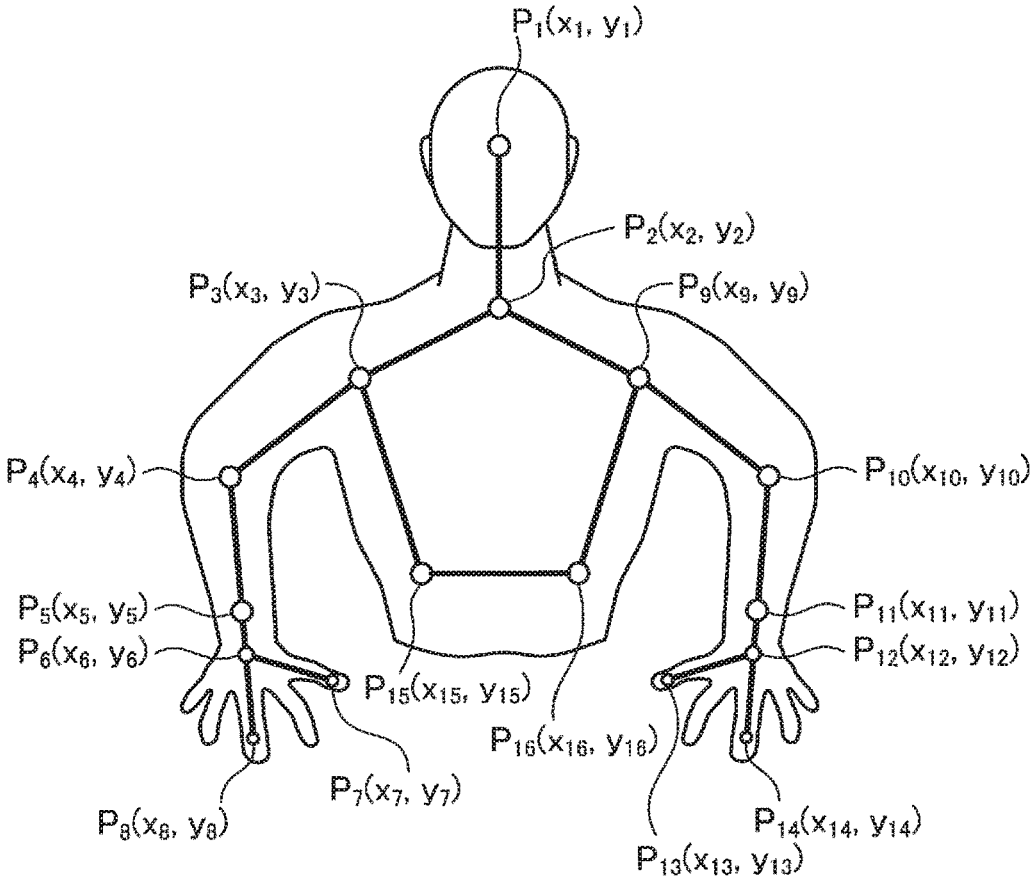
FIG. 4 is a view showing an example of skeleton information.

FIG. 4 is a view showing an example of skeleton information of the present embodiment. Each feature point is represented by a combination (binary coordinate information) of a coordinate value in an x direction (horizontal direction) and a coordinate value in a y direction (vertical direction). In the example of FIG. 4, a feature point P1 (x1, y1) corresponding to a head, a feature point P2 (x2, y2) corresponding to a neck, a feature point P3 (x3, y3) corresponding to a right shoulder, a feature point P4 (x4, y4) corresponding to a right elbow, a feature point P5 (x5, y5) corresponding to a right wrist, a feature point P6 (x6, y6) corresponding to a center point of a right hand, a feature point P7 (x7, y7) corresponding to a thumb of the right hand, a feature point P8 (x8, y8) corresponding to the middle finger of the right hand, a feature point P9 (x9, y9) corresponding to the left shoulder, a feature point P10 (x10, y10) corresponding to a left elbow, a feature point P11 (x11, y11) corresponding to a left wrist, a feature point P12 (x12, y12) corresponding to a center point of the left hand, a feature point P13 (x13, y13) corresponding to a thumb of the left hand, a feature point P14 (x14, y14) corresponding to a middle finger of the left hand, a feature point P15 (x15, y15) corresponding to a right hip, a feature point P16 (x16, y16) corresponding to a left hip are listed as the feature points of the skeleton information, but this disclosure is not limited to the above.

Returning to FIG. 3, the explanation will be continued. The determination unit 213 determines whether an action corresponding to any command is performed based on the action of the passenger recognized by the recognition unit 212. In the present embodiment, the determination unit 213 determines whether an action corresponding to any command is performed based on mapping information associating the commands with the actions. More specifically, the determination unit 213 identifies the commands in association with the actions and determines that an action corresponding to a specified command is performed when there is an action that matches the action of the passenger recognized by the recognition unit 212, among the actions included in the mapping information.

Figures 5, 6:
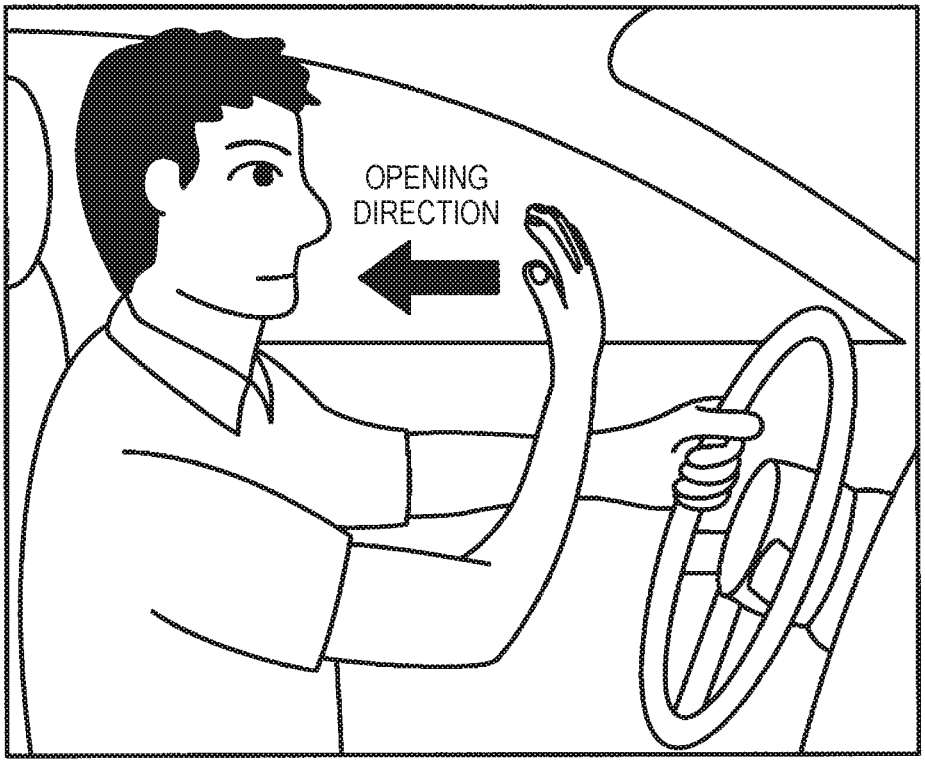
FIG. 5 is a diagram showing an example of mapping information.
FIG. 6 is a view showing an example of an action corresponding to an "OPEN" command.

FIG. 5 is a diagram showing an example of the mapping information. The mapping information may be stored in a memory (for example, ROM 202) in the image processing device 20 or may be stored in a memory other than the image processing device 20. In the example of FIG. 5, the command related to the control of the sunroof is exemplified, but the type of the command is not limited to the above.

In FIG. 5, the command denoted as "OPEN" is a command that instructs to open the sunroof, the command denoted as "CLOSE" is a command that instructs to close the sunroof, and the command denoted as "PAUSE" is a command that instructs to stop (interrupt) the opening and closing operation of the sunroof.

Figure 7:
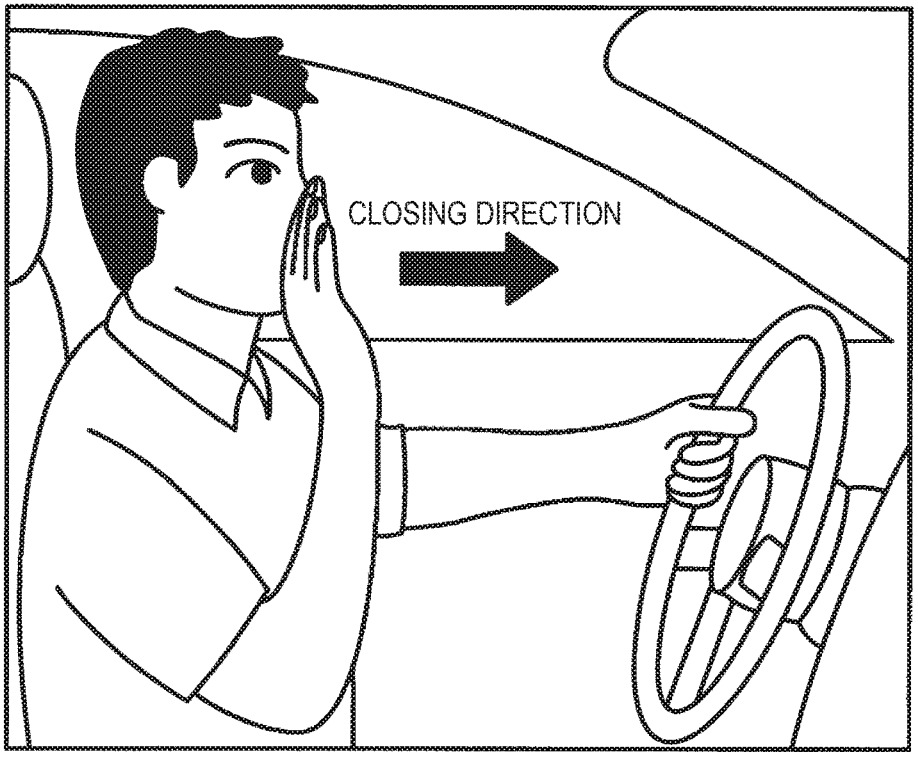
FIG. 7 is a view showing an example of an action corresponding to a "CLOSE" command.
Figure 8:
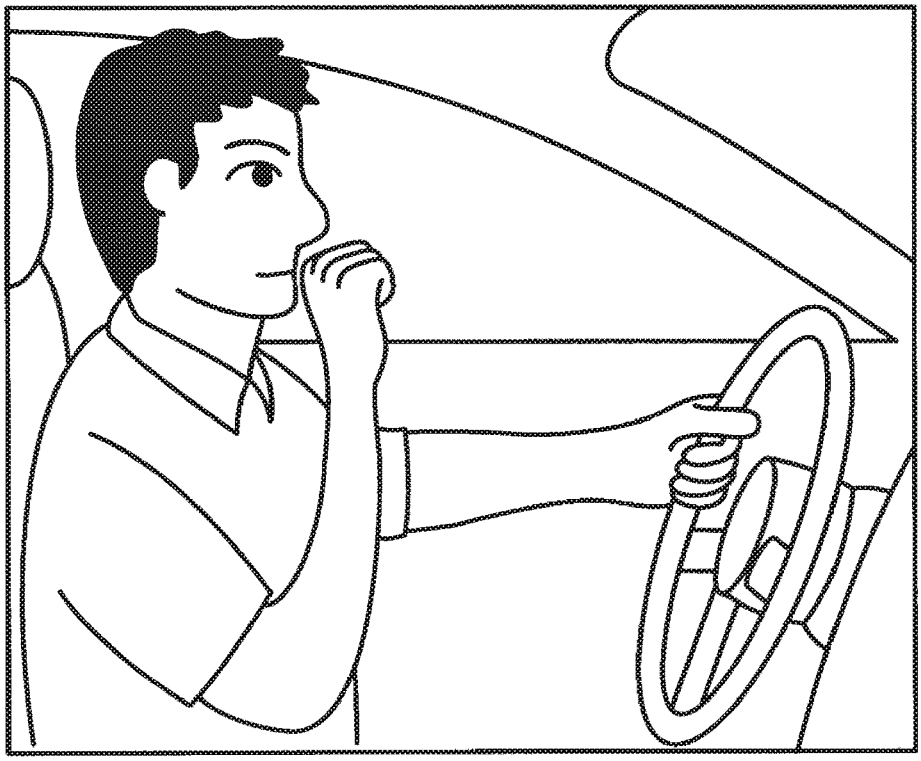
FIG. 8 is a view showing an example of an action corresponding to a "PAUSE" command.

As shown in FIG. 6, an action indicating that the hand is moved in the opening direction of the sunroof is associated with a command "OPEN". In addition, as shown in FIG. 7, an action indicating that the hand is moved in the closing direction of the sunroof is associated with a command "CLOSE". As shown in FIG. 8, associated with a command "PAUSE" is an action indicating raising a fist. The actions corresponding to each of the commands may be optionally set, but not limited thereto.

In this way, the determination unit 213 determines whether an action corresponding to any command is performed and inputs the determination result to the command output unit 214.

The command output unit 214 shown in FIG. 3 outputs command information indicating the command determined as corresponding to the performed action to the vehicle control device 30.

Figure 9:
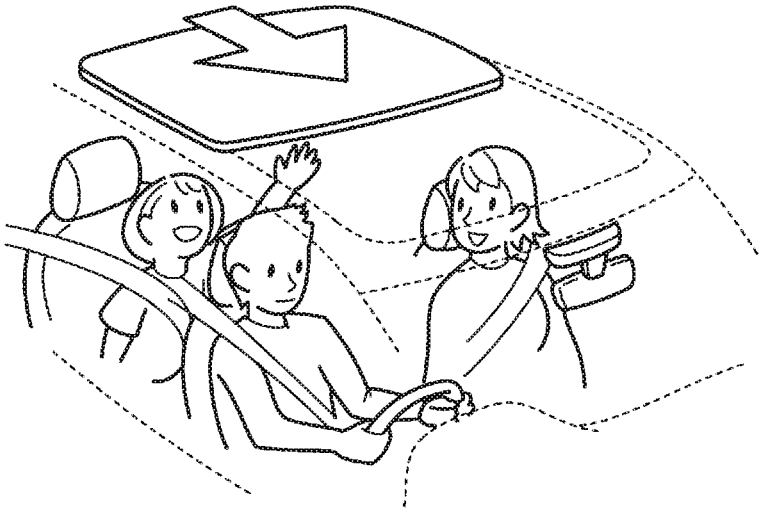
FIG. 9 is a view for explaining pinch of a passenger's hand by a sunroof.

In this example, when the command output unit 214 outputs the command information indicating the command "CLOSE" to the vehicle control device 30, the vehicle control device 30 closes the sunroof. At this time, as shown in FIG. 9, when the passenger in the backseat has reached the outside of the vehicle, if the closing operation continues, pinch of the passenger's hand by the sunroof occurs.

Accordingly, the image processing device 20 of the present embodiment detects a reference position indicating a position serving as a reference among the passenger's predetermined portions (in this example, "passenger's hand") based on a captured image captured by the imaging device 10 that images an interior of the vehicle and controls such that the closing operation of the sunroof is interrupted, when a coordinate value of the reference position detected based on the captured image during the closing operation of the sunroof exceeds a threshold value. This corresponds to the functions of the detection unit 215 and the control unit 216 shown in FIG. 3. Hereinafter, the functions of each of the detection unit 215 and the control unit 216 shown in FIG. 3 will be described.

The detection unit 215 detects a reference position indicating a position serving as a reference among the predetermined portions of the passenger based on a captured image captured by the imaging device 10 (captured image acquired by the acquisition unit 211). In this example, the predetermined portion is the passenger's hand, but not limited thereto, and accordingly, it may be a head of the passenger, for example. In addition, in the above example, the reference position is a center point of the hand, but not limited thereto, and accordingly, it may be a middle finger, and the like of the hand of the passenger, for example. Further, in this example, since all passengers in the vehicle (driver, passenger in the passenger seat, passengers in the backseat) are included as the passenger, it is assumed that the imaging device 10 is positioned (viewing angle and posture adjusted) such that all passengers in the car are imaged.

In this example, the detection unit 215 detects the reference position according to an instruction from the control unit 216 which will be described below, and notifies the control unit 216 of the detection result. While the method of detecting the reference position is optional, by way of example, the detection unit 215 generates the skeleton information described above for each passenger included in the captured image from the captured image acquired by the acquisition unit 211, and detects the position of the center point of the passenger's hand as the reference position based on the generated skeleton information for each passenger. In this example, while the recognition unit 212 and the detection unit 215 are separately provided, by way of example, the recognition unit 212 and the detection unit 215 may be configured as a common module (for example, in a mode in which the recognition unit 212 also serves the function of the detection unit 215).

Figure 10:
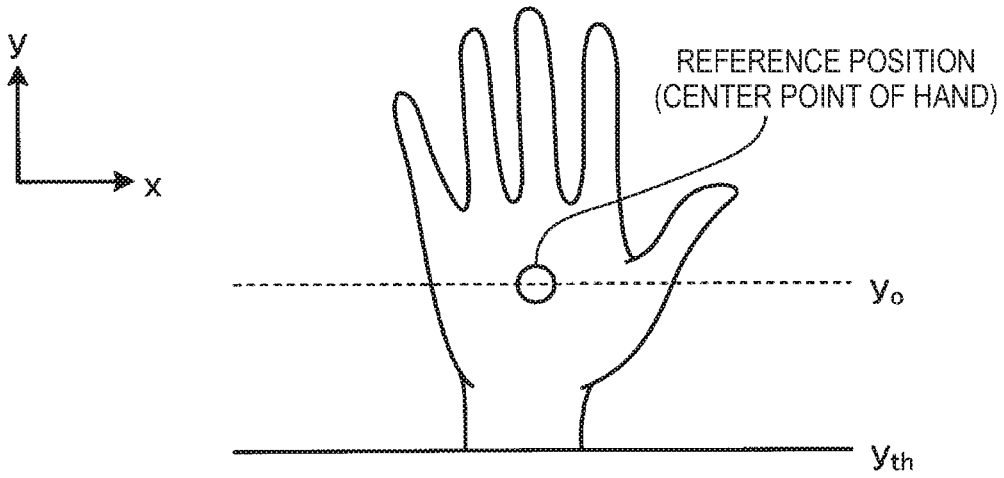
FIG. 10 is a view for explaining control by a control unit according to a first embodiment.

The control unit 216 performs control such that the closing operation of the sunroof is interrupted, when the coordinate value of the reference position detected by the detection unit 215 exceeds the threshold value during the closing operation of the sunroof. More specifically, as shown in FIG. 10, the control unit 216 performs control such that the closing operation of the sunroof is interrupted, when the coordinate value $y_0$ of the reference position (in this example, center point of the passenger's hand) in the vertical direction exceeds the first threshold value $y_{th}$ (as one aspect of the threshold value) for a certain period of time. In this example, the first threshold value $y_{th}$ is a coordinate value in the vertical direction based on which occurrence of pinch of the passenger's hand by the sunroof can be determined, and it can be determined that occurrence of pinch of the passenger's hand by the sunroof occurs when the coordinate value $y_0$ of the center point of the passenger's hand in the vertical direction is greater than the first threshold value $y_{th}$.

As an example of the control to interrupt the closing operation of the sunroof described above, the control unit 216 may transmit, to the vehicle control device 30, command information indicating a command instructing to interrupt the closing operation of the sunroof. The vehicle control device 30 may interrupt the closing operation of the sunroof by executing the command indicated by the command information received from the control unit 216.

In addition, in this example, when command information indicating the "CLOSE" command is output to the vehicle control device 30, the command output unit 214 notifies the control unit 216 of that. Upon receiving the notification, the control unit 216 recognizes that the sunroof is in closing operation and requests the detection unit 215 to detect the reference position. Upon receiving this request, the detection unit 215 detects the reference position based on the captured image acquired by the acquisition unit 211 and transmits the detection result to the control unit 216. Then, the control unit 216 determines whether or not to control such that the closing operation of the sunroof is interrupted, from the relationship between the coordinate value $y_0$ of the detected reference position in the vertical direction and the predetermined first threshold value $y_{th}$ based on the captured image. In this example, the command output unit 214 and the control unit 216 are separately provided, but not limited thereto, and for example, the command output unit 214 and the control unit 216 may be configured as a common module (for example, in a mode in which the command output unit 214 also serves the function of the control unit 216).

According to the present embodiment, only by extracting the reference position from the captured image, it is possible to determine whether pinch of the passenger's hand in the sunroof occurs, from the large/small relationship between the coordinate value $y_0$ of the extracted reference position in the vertical direction and the predetermined first threshold value $y_{th}$, so that it is unnecessary to perform a process of extracting the outline of the entire object such as a window frame or the like included in the captured image as in the related art. In addition, as compared with the case of extracting the outline of the entire object from the captured image as in the related art, the error occurring in the process of image recognition processing is smaller in the case of extracting one reference position point from the captured image as in this embodiment, and as a result, it is possible to improve the accuracy of determining whether pinch of the passenger's hand occurs in the opening and closing members provided in the vertical direction of the vehicle such as sunroof and the like.

In addition, the control unit 216 performs control such that the closing operation of the sunroof is resumed when a state in which the coordinate value $y_0$ of the reference position in the vertical direction is equal to or less than the first threshold value $y_{th}$ continues for a certain period of time after the sunroof closing operation is interrupted. For example, the control unit 216 may transmit command information indicating a command instructing to resume the closing operation of the sunroof to the vehicle control device 30. The vehicle control device 30 may resume the closing operation of the sunroof by executing the command indicated by the command information received from the control unit 216. In this example, when the possibility of pinch of a passenger's hand by the sunroof is eliminated, the closing operation of the sunroof is resumed, thus it is possible to complete the closing operation of the sunroof without requiring an action input (instruction input) by the passenger again.

Figure 11:
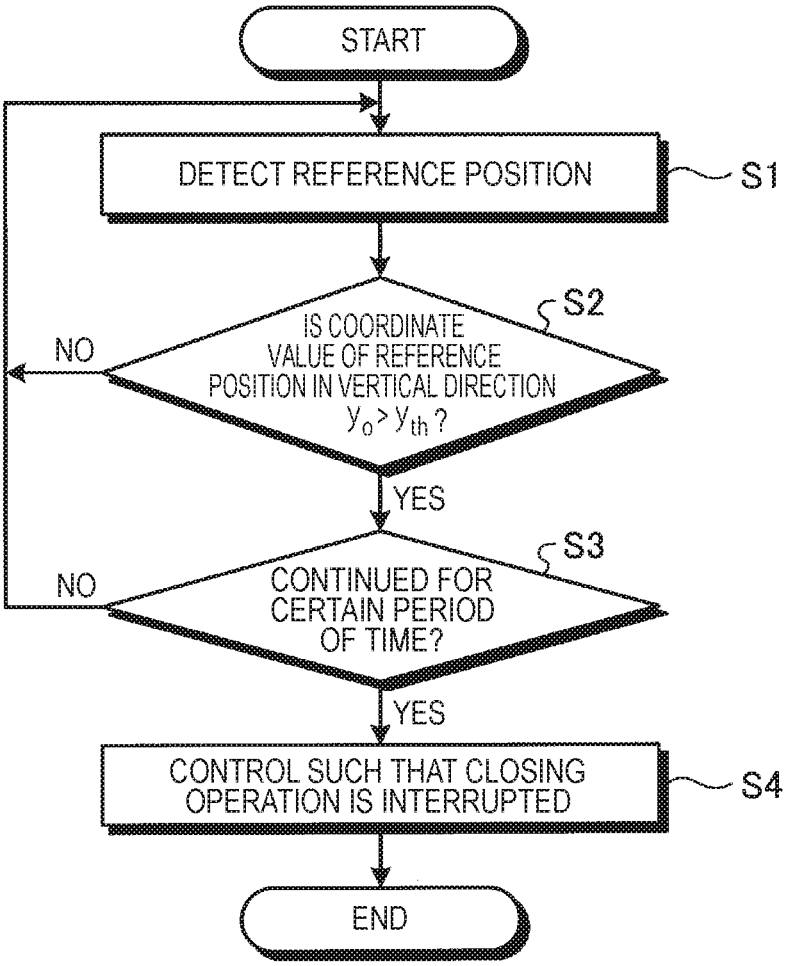
FIG. 11 is a flowchart showing an operation example of an image processing device according to a first embodiment.

FIG. 11 is a flowchart showing an action example of the image processing device 20 during the closing operation of the sunroof according to the present embodiment. Since the specific content of each step is as described above, where appropriate, detailed explanation thereof will not be repeated.

As shown in FIG. 11, the detection unit 215 first detects the reference position (the center point of the passenger's hand in this example) based on the captured image acquired by the acquisition unit 211 (step S1). Next, the control unit 216 determines whether the coordinate value $y_0$ of the reference position detected in step S1 in the vertical direction is greater than the first threshold value $y_{th}$ (step S2).

When the result of step S2 is affirmative (step S2: Yes), the control unit 216 determines whether a state in which the coordinate value $y_0$ of the reference position in the vertical direction is greater than the first threshold value $y_{th}$ has continued for a certain period of time (step S3). When the result of step S3 is negative (step S3: No), the processes from step S1 onward are repeated. On the other hand, when the result of step S3 is affirmative (step S3: Yes), the control unit 216 performs control such that the closing operation of the sunroof (step S4) is interrupted.

As described above, in the present embodiment, it is controlled such that the closing operation of the sunroof is interrupted, when the coordinate value $y_0$ of the reference position of the passenger's predetermined portion (in this example, the center point of the passenger's hand) detected in the vertical direction exceeds the first threshold value $y_{th}$ for a certain period of time, based on the captured image captured by the imaging device 10 that images an interior of a vehicle during the closing operation of the sunroof. As a result, it is possible to detect with high accuracy whether the pinch of the passenger's hand in the sunroof occurs, and it is possible to completely prevent the pinch of the passenger's hand in the sunroof.

Second Embodiment

Next, a second embodiment will be described. Descriptions of the portions common to the first embodiment described above will not be appropriately repeated. In the first embodiment described above, a member (for example, a sunroof) provided in the vehicle in the vertical direction is assumed as the opening and closing member. In the present embodiment, there is a difference in that a member provided in the horizontal direction in the vehicle is assumed as the opening and closing member, such as, a slide door or a power window or the like, for example. In the following description, the slide door will be described as an opening and closing member as an example, but this disclosure is not limited thereto. In this example, since the configuration other than the function included in the control unit 216 is the same as that of the first embodiment described above, a detailed description thereof will not be repeated.

Likewise the first embodiment described above, the basic function of the control unit 216 is that it performs control such that, during the closing operation of an openable and closable opening and closing member, the closing operation of the opening and closing member is interrupted, when a coordinate value of a reference position detected by the detection unit 215 exceeds a threshold value. In this example, the opening and closing member is the slide door, the predetermined portion is the hand of the passenger, and the reference position is the center point of the hand of the passenger, but not limited thereto.

Figure 12:
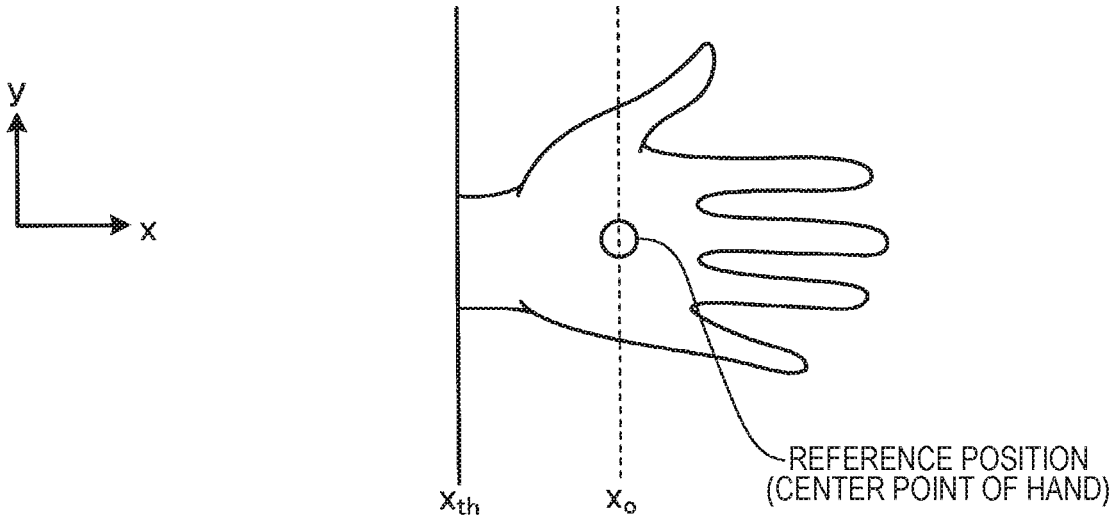
FIG. 12 is a diagram for explaining control by a control unit according to a second embodiment.

As shown in FIG. 12, the control unit 216 of the present embodiment performs control such that the closing operation of the slide door is interrupted, when the coordinate value $x_0$ of the center point of the hand of passenger in the horizontal direction exceeds the second threshold value $x_{th}$ (one aspect of the threshold value) for a certain period of time during the closing operation of the slide door. In this example, the second threshold value $x_{th}$ is a coordinate value in the horizontal direction based on which occurrence of pinch of the passenger's hand by the slide door can be determined, and it can be determined that pinch of the passenger's hand by the slide door occurs when the coordinate value $x_0$ of the center point of the passenger's hand in the horizontal direction is greater than the second threshold value $x_{th}$.

As an example of the control to interrupt the closing operation of the slide door, the control unit 216 may transmit, to the vehicle control device 30, command information indicating a command instructing to interrupt the closing operation of the slide door. The vehicle control device 30 may interrupt the closing operation of the slide door by executing the command indicated by the command information received from the control unit 216.

Likewise the first embodiment described above, when command information indicating a command instructing the closing operation of the slide door is output to the vehicle control device 30, the command output unit 214 notifies the control unit 216 of that. The action corresponding to the command instructing the closing operation or the command instructing the opening operation of the slide door (action defined in advance for each command) may be optionally set. Upon receiving the notification, the control unit 216 recognizes that the slide door is in closing operation and requests the detection unit 215 to detect the reference position. Upon receiving this request, the detection unit 215 detects the reference position based on the captured image acquired by the acquisition unit 211 and transmits the detection result to the control unit 216. Then, the control unit 216 determines whether or not to control such that the closing operation of the slide door is interrupted, from the relationship between the coordinate value $x_0$ of the detected reference position in the horizontal direction and the predetermined second threshold value $x_{th}$ based on the captured image.

According to the present embodiment, only by extracting the reference position from the captured image, it is possible to determine whether pinch of the passenger's hand in the slide door occurs, from the large/small relationship between the coordinate value $x_0$ of the extracted reference position in the horizontal direction and the predetermined second threshold value $x_{th}$, so that it is unnecessary to perform a process of extracting the outline of the entire object such as a window frame or the like included in the captured image as in the related art. In addition, as compared with the case of extracting the outline of the entire object from the captured image as in the related art, the error occurring in the process of image recognition processing is smaller in the case of extracting one reference position point from the captured image as in this embodiment, and as a result, it is possible to improve the accuracy of determining whether pinch of the passenger's hand occurs in the opening and closing member provided in the horizontal direction of the vehicle such as slide door and the like.

In addition, the control unit 216 performs control such that the closing operation of the slide door is resumed when, after the closing operation of the slide door is interrupted, a state in which the coordinate value $x_0$ of the reference position in the horizontal direction is equal to or smaller than the second threshold value $x_{th}$ continues for a certain period of time. For example, the control unit 216 may transmit command information indicating a command instructing to resume the closing operation of the slide door to the vehicle control device 30. The vehicle control device 30 may resume the closing operation of the slide door by executing the command indicated by the command information received from the control unit 216. In this example, when the possibility of pinch a passenger's hand by the slide door is eliminated, the closing operation of the slide door is resumed, thus it is possible to complete the closing operation of the slide door without requiring an action input (instruction input) by the passenger again.

Figure 13:
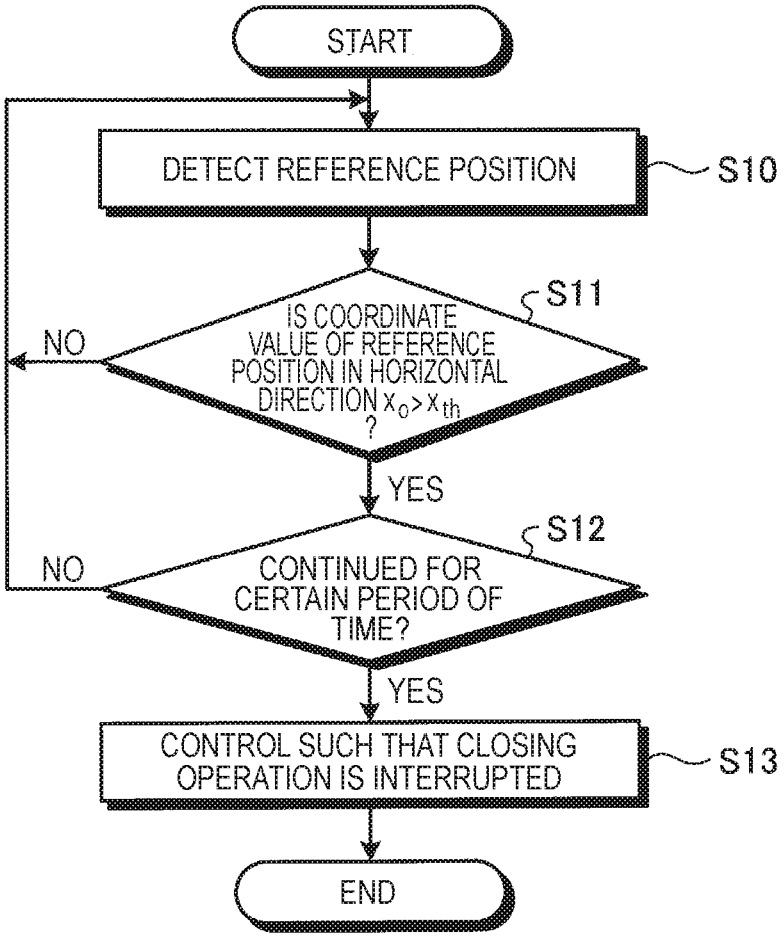
FIG. 13 is a flowchart showing an operation example of an image processing device of the second embodiment.

FIG. 13 is a flowchart showing an operation example of the image processing device 20 during the closing operation of the slide door according to the present embodiment. Since the specific content of each step is as described above, where appropriate, the detailed explanation thereof will not be repeated.

As shown in FIG. 13, the detection unit 215 first detects the reference position (the center point of the passenger's hand in this example) based on the captured image acquired by the acquisition unit 211 (step S10). Next, the control unit 216 determines whether the coordinate value $x_0$ of the reference position detected in step S10 in the horizontal direction is greater than the second threshold value $x_{th}$ (step S11).

When the result of step S11 is affirmative (step S11: Yes), the control unit 216 determines whether a state in which the coordinate value $x_0$ of the reference position in the horizontal direction is greater than the second threshold value $x_{th}$ has continued for a certain period of time (step S12). When the result of step S12 is negative (step S12: No), the processes from step S10 onward are repeated. On the other hand, when the result of step S12 is affirmative (step S12: Yes), the control unit 216 performs control such that the closing operation of the slide door (step S13) is interrupted.

As described above, in the present embodiment, it is controlled such that the closing operation of the slide door is interrupted, when the coordinate value $x_0$ of the reference position of the passenger's predetermined portion (in this example, center point of the passenger's hand) detected in the horizontal direction exceeds the second threshold value $x_{th}$ (as one aspect of the threshold value) for a certain period of time based on the captured image captured by the imaging device 10 that images an interior of the vehicle during the closing operation of the slide door. As a result, it is possible to detect with high accuracy whether pinch of the passenger's hand occurs in the slide door and it is possible to completely prevent the pinch of the passenger's hand in the slide door.

Although the embodiment according to this disclosure has been described above, this disclosure is not limited to the above-described embodiment as it is, and in the implementation stage, it can be embodied by modifying constituent elements without departing from the gist thereof. In addition, various disclosures may be formed by appropriately combining a plurality of constituent elements disclosed in the above embodiment. For example, some constituent elements may be deleted from all the constituent elements shown in the embodiment. In addition, each embodiment and modification example described above can be optionally combined.

The type of the openable and closable opening and closing member which is provided in the vehicle is not limited to those described above and may be provided in a back door or the like, for example.

In addition, the control unit 216 described above may be mounted on the vehicle control device 30 side, for example. In this case, the combination of the image processing device 20 and the vehicle control device 30 corresponds to the "control device". In short, the control device may be in a form including at least the detection unit 215 and control unit 216 described above, and may be constituted by a single device or a plurality of devices (detection unit 215 and control unit 216 are distributed in a plurality of apparatuses).

A control device according to an aspect of this disclosure includes a detection unit that detects a reference position indicating a position serving as a reference among passenger's predetermined portions based on a captured image captured by an imaging device that images an interior of a vehicle, and a control unit that is provided in the vehicle and performs control such that, during a closing operation of an openable and closable opening and closing member, the closing operation of the opening and closing member is interrupted, when a coordinate value of a reference position detected by the detection unit exceeds a threshold value. According to this configuration, it is possible to detect with high accuracy the occurrence of the pinch of the predetermined portion in the opening and closing member, and it is possible to completely prevent the pinch of the predetermined portion by the opening and closing member.

In the control device according to the aspect, for example, the threshold value may include a first threshold value and the control unit performs control such that the closing operation of the opening and closing member is interrupted when the coordinate value of the reference position in a vertical direction exceeds the first threshold value for a certain period of time. According to this configuration, it is possible to detect with high accuracy the occurrence of the pinch of foreign matter in opening and closing member, and it is possible to completely prevent the pinch of the predetermined portion in the opening and closing member.

In the control device according to the aspect, for example, the control unit may perform control such that the closing operation of the opening and closing member is resumed when the closing operation of the opening and closing member is interrupted, a state in which the coordinate value of the reference position in the vertical direction is equal to or smaller than the first threshold value continues for a certain period of time. According to this configuration, the closing operation of the opening and closing member is resumed when the possibility of pinch of the predetermined portion in the opening and closing member is eliminated, such that it is possible to complete the closing operation of the opening and closing member without requiring an action input (instruction input) by the passenger again.

In the control device according to the aspect, for example, the predetermined portion may be a passenger's hand, and the opening and closing member may be a sunroof. According to this configuration, it is possible to detect with high accuracy whether pinch of the passenger's hand in the sunroof occurs, and it is possible to completely prevent the pinch of the passenger's hand in the sunroof.

In the control device according to the aspect, for example, the threshold value may include a second threshold value and the control unit may perform control such that the closing operation of the opening and closing member is interrupted when a coordinate value of the reference position in a horizontal direction exceeds the second threshold value for a certain period of time. According to this configuration, it is possible to detect with high accuracy the occurrence of the pinch of the foreign matter in the opening and closing member, and it is possible to completely prevent the pinch of the predetermined portion in the opening and closing member.

In the control device according to the aspect, for example, the control unit may perform control such that the closing operation of the opening and closing member is resumed when, after the closing operation of the opening and closing member is interrupted, a state in which the coordinate value of the reference position in the horizontal direction is equal to or smaller than the second threshold value continues for a certain period of time. According to this configuration, the closing operation of the opening and closing member is resumed when the possibility of pinch of the predetermined portion in the opening and closing member is eliminated, such that it is possible to complete the closing operation of the opening and closing member without requiring an action input (instruction input) by the passenger again.

In the control device according to the aspect, for example, the predetermined portion may be a passenger's hand and the opening and closing member may be a slide door or a power window. According to this configuration, it is possible to detect with high accuracy whether the pinch of the passenger's hand occurs in the slide door or the power window and it is possible to completely prevent the pinch of the passenger's hand in the slide door or the power window.

A program according to another aspect of this disclosure causes a computer to execute a detection step of detecting a reference position indicating a position serving as a reference among passenger's predetermined portions based on a captured image captured by an imaging device that images an interior of a vehicle; and a control step of controlling such that, during a closing operation of an openable and closable opening and closing member, the closing operation of the opening and closing member is interrupted, when a coordinate value of the reference position detected in the detection step exceeds a threshold value.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A control device comprising:

a detection unit that detects a reference position indicating a position of a predetermined portion of a passenger based on a captured image captured by an imaging device that images an interior of a vehicle; and a control unit that is provided in the vehicle and performs control such that, during a closing operation of an openable and closable opening and closing member, the closing operation of the opening and closing member is interrupted, when a coordinate value of the reference position detected by the detection unit exceeds a threshold value, wherein the threshold value includes a first threshold value, the control unit performs control such that the closing operation of the opening and closing member is interrupted when the coordinate value of the reference position in a vertical direction exceeds the first threshold value for a certain period of time, and the control unit performs control such that the closing operation of the opening and closing member is resumed when, after the closing operation of the opening and closing member is interrupted, a state in which the coordinate value of the reference position in the vertical direction is equal to or smaller than the first threshold value continues for a certain period of time.

2. The control device according to claim 1, wherein the predetermined portion is a passenger's hand, and the opening and closing member is a sunroof.

3. The control device according to claim 1, wherein the control unit performs control such that the closing operation of the opening and closing member is resumed when, after the closing operation of the opening and closing member is interrupted, a state in which the coordinate value of the reference position in the horizontal direction is equal to or smaller than the second threshold value continues for a certain period of time.

4. The control device according to claim 3, wherein the predetermined portion is a passenger's hand, and the opening and closing member is a slide door or a power window.

5. A control device comprising:

a detection unit that detects a reference position indicating a position of a predetermined portion of a passenger based on a captured image captured by an imaging device that images an interior of a vehicle; and a control unit that is provided in the vehicle and performs control such that, during a closing operation of an openable and closable opening and closing member, the closing operation of the opening and closing member is interrupted, when a coordinate value of the reference position detected by the detection unit exceeds a threshold value, wherein the threshold value includes a second threshold value, and the control unit performs control such that the closing operation of the opening and closing member is interrupted when a coordinate value of the reference position in a horizontal direction exceeds the second threshold value for a certain period of time.

6. A program that causes a computer to execute:

a detection step of detecting a reference position indicating a position of a predetermined portion of a passenger based on a captured image captured by an imaging device that images an interior of a vehicle; and a control step of controlling such that, during a closing operation of an openable and closable opening and closing member, the closing operation of the opening and closing member is interrupted when a coordinate value of the reference position detected in the detection step exceeds a threshold value, wherein the threshold value includes a first threshold value, the control unit performs control such that the closing operation of the opening and closing member is interrupted when the coordinate value of the reference position in a vertical direction exceeds the first threshold value for a certain period of time, and the control unit performs control such that the closing operation of the opening and closing member is resumed when, after the closing operation of the opening and closing member is interrupted, a state in which the coordinate value of the reference position in the vertical direction is equal to or smaller than the first threshold value continues for a certain period of time.

7. A program that causes a computer to execute:

a detection step of detecting a reference position indicating a position serving as a reference among passenger's predetermined portions based on a captured image captured by an imaging device that images an interior of a vehicle; and a control step of controlling such that, during a closing operation of an openable and closable opening and closing member, the closing operation of the opening and closing member is interrupted when a coordinate value of the reference position detected in the detection step exceeds a threshold value, wherein the threshold value includes a second threshold value, and the control unit performs control such that the closing operation of the opening and closing member is interrupted when a coordinate value of the reference position in a horizontal direction exceeds the second threshold value for a certain period of time.

* * * * *